United States Patent [19]

Steinicke et al.

[11] 4,370,929

[45] Feb. 1, 1983

[54] CONTACT HEAD

[76] Inventors: Wolfgang Steinicke, Olympiaring 43; Wolfgang Badura, Maerzfeld 8; Alois Schiessl, Hochfeldstrasse 26; Werner Weinzierl, Schillerstrasse 36a, all of D-8230 Bad Reichenhall; Hartmut Krone, Gaihofstrasse 13, D-7841 Auggen, all of Fed. Rep. of Germany

[21] Appl. No.: 175,024

[22] Filed: Aug. 4, 1980

[30] Foreign Application Priority Data

Aug. 14, 1979 [DE] Fed. Rep. of Germany ..... 2932921

[51] Int. Cl.[3] ..... F42C 19/12; F42B 9/08

[52] U.S. Cl. ..... 102/202; 102/200; 102/472

[58] Field of Search ..... 102/202, 202.5, 202.14, 102/380, 472, 200

[56] References Cited

U.S. PATENT DOCUMENTS

| | | | |
|---|---|---|---|
| 2,447,758 | 8/1948 | Lubbock et al. | 102/202 |
| 2,828,692 | 4/1958 | Webster | 102/202 |
| 3,439,617 | 4/1969 | Boyd et al. | 102/202 |

FOREIGN PATENT DOCUMENTS

| | | |
|---|---|---|
| 1100507 | 9/1961 | Fed. Rep. of Germany . |
| 1157115 | 11/1963 | Fed. Rep. of Germany . |

*Primary Examiner*—Charles T. Jordan

*Attorney, Agent, or Firm*—Oblon, Fisher, Spivak, McClelland & Maier

[57] ABSTRACT

A contact head for a projectile which is capable of being fired from an electrically actuable launcher comprises a solid metal core formed on one side with a recess for constituting a propellent charge chamber in which are located a propellent charge and a primer capsule. The recess is closed by a base plate having breakage points for the egress of gases generated by ignition of the charge. The part of the core surrounding the recess is formed with first and second sets of bores spaced equiangularly about the axis of the core for receiving connecting screws for connecting the, contact head to a projectile and for receiving fixing screws for fixing the base plate to the core, respectively. An elastic protective member coaxially surrounds the head and is preferably subdivided into three rings, e.g. of rubber, which carry two metallic contact rings connected to the primer capsule by firing circuit wires. The use of a solid metal core as opposed to plastics members used in the prior art provides better control of the flight of the projectile and enables the contact head to withstand more rigorous conditions.

9 Claims, 3 Drawing Figures

CONTACT HEAD

FIELD OF THE INVENTION

This invention relates to a contact head for a projectile which is capable of being fired from an electrically actuable launcher.

THE PRIOR ART

The contact heads of conventional projectiles, such as smoke projectiles, which are fired from so-called Wegmann launchers, are moulded plastics components containing metal contact rings; the only reason for using plastics is that the contact rings have to be embedded in insulated manner in the outer casing of the contact head. An essential condition for such projectiles is that they must withstand temperatures of from −40° C. to +70° C., and still remain fully operational. Therefore, they have to remain virtually gas- and water-tight over a fairly long period under all kinds of environmental conditions to ensure that they remain operational. However, conventional contact heads made of plastics have a tendency to crack and thus become pervious to moisture, precisely under the extreme temperature stresses acting on them. This cannot be prevented by the use of particularly high quality plastics, since contact heads of this kind have a relatively complicated form which means that certain concessions have to be made in the processes required for producing them. A further disadvantage of the known contact heads made of plastics is that they cannot withstand very great mechanical stresses, particularly under cold conditions, i.e. they cannot withstand great firing impact when the projectiles to which they are fitted are fired. Thus, projectiles containing conventional contact heads made of plastics cannot be fired over great distances or be subjected to great acceleration. However, since combat vehicles carrying launchers for these projectiles have to be able to protect themselves or conceal themselves in a smoke screen as fast as possible when under threat, the projectiles required for this must be capable of being fired to the required distance as fast as possible, and this requires great acceleration when the projectile is launched. A further disadvantage of the conventional contact heads is the fact that in many cases plastics are not compatible with one another, and this has a detrimental effect on the various sealing means provided thereon, such as sealing rings and adhesives, for example. Therefore, in the course of time, these sealing rings may become pervious, and the effects on one another of the sealing agents and the plastics of the contact head in question may also cause the plastics material to become brittle, thus further increasing the risk of cracking.

The rather low mechanical strength of the propellant charge chamber provided in contact heads made of plastics also means that it is impossible to use propellant charges which burn up completely under high pressure, i.e. with high damming, and this further restricts the acceleration and range of firing which can be achieved. Moreover, in the majority of known contact heads, the propellent charge chambers are generally mounted eccentrically, with the result that, owing to the eccentric thrust thus occurring, there is greater spinning of the projectile when fired. This also affects the range of firing which can be achieved and is a disadvantage particularly in projectiles which are intended to fly in a stable manner in order that, during their flight, for example, a specific projectile agent contained therein, such as a radar jamming material or an infra-red confusing material, can be ejected in a particular direction.

The complicated form of the known contact heads also means that they are very easily deformed when produced from plastics, so that the surfaces at which they are connected to a canister-like projectile do not always provide a planar abutment. Moreover, this cannot be achieved by interposing sealing means therebetween, since it is only possible to a limited extent to balance out any irregularities in shape by forcefully tightening fixing screws between the contact head and the projectile container, owing to the lack of mechanical strength of said contact head. Consequently, the functional parts of an ignition chain between the contact head and the projectile container cannot be adequately protected from the penetration of atmospheric moisture.

A projectile, namely a smoke candle, having a contact head made of plastics, has been described, for example, in DE-PS 11 00 507. A propellant charge chamber and a manually actuable friction igniter are eccentrically mounted in the contact head. The propellent charge chamber comprises a lid and the propellent charge can be ignited electrically by means of a primer capsule via contact rings located on the outer casing of the contact head and corresponding firing circuits. The propellent charge chamber and the manually actuatable friction igniter are each connected, via corresponding ignition delay members, to a rod-shaped ignition charge unit (detonator) extending in the smoke composition, these detonators also being eccentrically mounted.

A further development of the above mentioned smoke candle is disclosed in DE-AS 11 57 115. Again, the contact head of this smoke candle is made of plastics and centrally mounted in the contact head is a manually actuatable friction igniter by means of which an ignition charge unit (ignition charge) passing eccentrically into the smoke composition can be ignited via an ignition delay member. Also centrally mounted in this contact head is a propellent charge member having a propellent charge (rocket composition) by means of which an ignition charge unit (ignition charge) passing centrally into the smoke composition can be ignited via an ignition delay member. The central arrangement of the propellant charge in the contact head in this smoke candle is mainly intended to give it the advantage, over the smoke candle described in DE-PS 11 00 507, that it can be fired over greater distance, by means of its rocket drive, as a non-ballistic missile.

The two smoke candles referred to above comprise contact heads which are produced from plastics, in known manner, and they therefore also have all the disadvantages described in connection with conventional projectiles of this kind.

In view of the above mentioned disadvantages of the conventional contact heads for projectiles which can be fired from electrically actuatable launchers, it is an object of the invention to provide a contact head which is mechanically capable of withstanding high stresses, which can be rendered water- and gas-tight and which can be made resistant to temperatures within the range from −40° C. to +70° C.

DESCRIPTION OF THE INVENTION

According to the present invention, there is provided a contact head for a projectile which is capable of being fired from an electrically actuable launcher, said head comprising a solid metal core formed on one side with a recess constituting a propellent charge chamber, formed with a central bore leading to said recess for reception of an ignition charge unit, formed with substantially radially extending bores leading into said recess for the reception of firing circuit wires, formed in the part surrounding said recess with a first set of bores having an internal shoulder substantially in the centre of the thickness of said part for receiving connecting screws for attaching the contact head to a container of said projectile, and formed also in the part surrounding said recess with a second set of threaded bores for receiving the threaded shanks of fixing screws, said bores of said first and second sets alternating at substantially equal angles about the longitudinal axis of said core; a propellent charge located in said propellent charge chamber; a primer capsule disposed in said propellent charge; an elastic protective ring member coaxially surrounding said core; first and second contact rings carried by said protective ring member; fixing circuit wires connecting said first and second contact rings and said primer capsule; a base plate secured to said one side of the core so as tightly to seal off at least said propellent charge chamber, the base plate being formed with bores corresponding with and adapted to register with the bores of the first and second sets formed in the part of the core surrounding said recess, and having breakage points for the egress of gases upon ignition of said propellent charge; connecting screws received in said bores of said first set of bores; and fixing screws fixing said base plate to the core and threadedly engaging in the bores of the second set of bores.

In a particular embodiment of this contact head, which is used particularly if additional components such as special means for a particular distribution of the smoke gases leaving a smoke projectile are provided between the contact head and a canister-like projectile container connected thereto, the second set of threaded bores is preferably constructed so as to widen out, substantially from the centre to the head part of the metal core, at a stepped portion, to form non-threaded perforations for receiving the heads of corresponding mounting screws. In this way, any additional components provided between the contact head and a projectile container can be screwed to one another and, optionally, to the projectile container, independently of the contact head, and the heads of the mounting screws used for this purpose can be accommodated in the corresponding non-threaded perforations without getting in the way. At the same time, there is the advantage that the mounting screws located in the non-threaded perforations can be tightened, if desired, by passing a spanner through the second set of threaded bores, without having to dismantle the contact head completely be removing the three connecting screws provided in the first set of bores.

Preferably, an annular groove for receiving a sealing ring is formed in the head part of the metal core, between the central bore and the first set of bores and the threaded bores or the optional non-threaded perforations which may be associated therewith. This annular groove, together with the sealing ring and the flat abutment surface on the head part of the metal core, ensures a further improvement in the tight seal between the contact head and a projectile container or additional components provided therebetween.

As already stated, the elastic protective ring surrounding the solid metal core so as to provide a tight seal is preferably in three parts, consisting of a top ring carrying a first contact ring, a middle ring and a bottom ring carrying a second contact ring, while appropriate recesses for receiving soldering tabs of the contact rings are formed at the points of contact of the three individual rings adjacent to the first circuit bores located in the central core. Due to this three-part construction of the protective ring made of elastic material, the protective ring, contact rings and firing circuit wires to be connected thereto can be assembled particularly simply, by first placing the middle ring, for example, on the metal core, then soldering the associated firing circuit wires on to the soldering tabs of the two contact rings, and finally fitting the bottom ring and top ring in position and thus inserting them into the contact rings.

The top ring of the preferably three-part elastic protective ring, which is located at the head part of the metal core, preferably broadens out to form a projecting sealing bead. Preferably, the sealing bead thus formed corresponds in its outer diameter to the inner diameter of a launcher from which the projectile containing this contact head is fired, thus ensuring that this contact head fits tightly and in sealed manner in the launcher. Thus, the sealing bead balances out the annular slot existing between a launcher and a projectile fitted with this contact ring and therefore also ensures reproducible ranges of firing.

The elastic protecting ring preferably consists of natural or synthetic rubber as this ensures that an elastic protective layer is provided in a relatively close-fitting arrangement around the metal core of the contact head, to make the contact ring relatively resistant to impact and blows. The metal core located in the elastic protective ring or in the three individual rings ensures that the other components to be attached thereto can be connected accurately and at the same time also permits the formation of a solid propellent charge chamber of relatively large volume in which it is also possible to accommodate propellent charges which will only burn completely under high pressure, i.e. with high damming. When propellent charges of this kind are used, there is a substantial reduction in the soiling of the launcher and at the same time very great acceleration and range can be achieved for an appropriate projectile.

For attaching the base plate to the metal core of the contact head, as stated above, the base plate is formed with a number of bores corresponding to the first set of bores and the second set of threaded bores. The bores in the base plate corresponding to the first set of bores are preferably smaller than the diameter of the heads of the connecting screws located in the first set of bores but large enough to allow a spanner for actuating these connecting screws to be inserted. The connecting screws located in the first set of bores are therefore preferably socket head cap screws which can be actuated by using a spanner designed for such screws. In this way, the bores in the base plate in register with the first set of bores can be kept so small that the three connecting screws can be held in the first set of bores via the base plate without falling out. The bores in the base plate corresponding to the second set of threaded bores have a diameter such that only the threaded shanks of fixing screws can be passed through them and be screwed tight to attach the base plate to the metal core. Appropriately, screws with at least equally large screw heads and an equally thick threaded shank are used as the connecting screws and fixing screws, so that, preferably, all the bores located in the base plate may be the same size.

In order to provide the breakage points, the base plate preferably comprises, in its central region opposite the propellent charge chamber, gas outlet ports which are sealed off from the atmosphere by covering foil. This covering foil appropriately consists of metal foil stuck over the gas outlet ports. The construction of the base plate with breakage points may, however, also be obtained without the provision of any special gas outlet ports simply by defining the thickness of the base plate so precisely that the gas pressure produced after ignition of the propellent charge in the propellent charge chamber causes this base plate to bulge outwardly in the portions located between the fixing screws, so that the combustion gases can flow out laterally from the contact head and pass into the corresponding launcher, whilst some can also escape through the bores in the base plate for locating the connection scress. The construction of the base plate with breakage points may also be obtained by making the thickness of its central region opposite the propellent charge chamber such that the base plate is simply torn open in this central region under the effect of the gas pressure produced.

The propellent charge chamber located in the metal core is preferably sealed off from the atmosphere by means of a sealing ring provided in the region of the propellent charge chamber, between the metal core and the base plate. Opposite the central bore provided in the head part of the metal core, the propellent charge chamber is appropriately also sealed off by means of a protective film, which may again consist of tin foil attached by adhesive.

The provision of a sealing ring between the metal core and the base plate ensures that a tightly sealed joint between these components is obtained.

The solid metal core and the base plate preferably consist of aluminium, which advantageously means that these components, particularly the metal core, can be formed and produced by extrusion moulding.

The fact that, in the present contact head the metal core can be independently screwed to an appropriate projectile container by means of the connecting screws located in the first set of bores and to the base plate by means of the fixing screws engaging in the threaded bores of the metal core, advantageously ensures that the gas pressure produced after ignition of the propellent charge in the propellent charge chamber can only act on the base plate, since the metal core is separately connected to the projectile container via the first set of bores and the connecting screws located therein. Therefore, if the base plate were to spring open, which is extremely unlikely, this would not affect the operation of a projectile containing the present contact head. Moreover, the separate connections between the base plate and the metal core and the metal core and the projectile container enable the base plate to be forcefully connected to the metal core, which is necessary owing to the required leaktight seal of the propellent charge chamber and the high gas pressure produced, and also enable the metal core to be only cohesively bonded to the projectile container by lightly tightening the fixing screws, which is particularly important if the metal core consists of a relatively soft material, i.e. if it is an extrusion moulded aluminium component.

The firing circuit wires are sealed off from the propellent charge chamber in the firing circuit bores provided in the metal core, by means of an adhesive which remains elastic, e.g. consisting of an epoxy resin and bitumen. They are separated from one another outside the metal core by the elastic material of the protective ring, e.g. by the middle ring, and can readily be exposed to the atmosphere and allowed to get wet without any risk of a short circuit.

The connecting screws in the first set of bores of the metal core are accessible through the corresponding bores formed in the base plate, for the purpose of attaching a projectile container. These bores are big enough for the insertion of a spanner for socket head cap screws but at the same time are small enough to prevent the connecting screws from falling out. The present contact head can therefore be completely assembled before being screwed on to the associated canister-type projectile container. Conversely, it can advantageously also be removed without opening or damaging the contact head.

BRIEF DESCRIPTION OF THE DRAWINGS

In order to enable the invention to be more readily understood, reference will now be made to the accompanying drawings, which illustrate diagrammatically and by way of example an embodiment thereof, and in which.

DESCRIPTION OF PREFERRED EMBODIMENT

Figure 1:
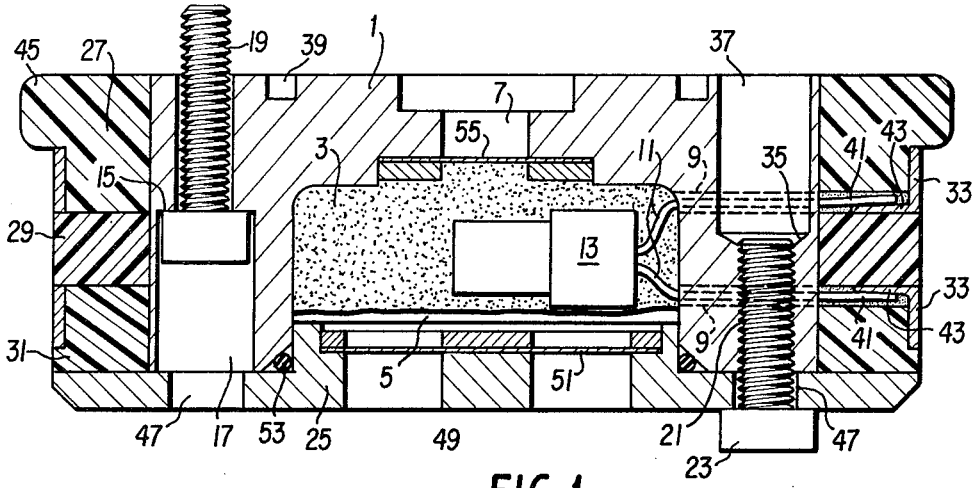
FIG. 1 is a vertical section through a contact head according to the invention.
Figure 2:
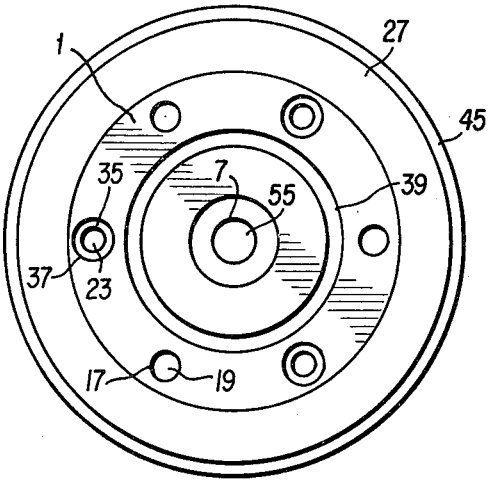
FIG. 2 is a view from above of the head part of the contact head shown in FIG. 1.

Referring now to the drawings, there is shown a contact head for a projectile capable of being fired from an electrically actuable launcher. The contact head comprises a solid metal core 1, made of aluminium, in the centre of which there is formed a propellent charge chamber 5 in which a propellent charge 3 is located. A central bore 7 is formed in the core 1 and leads from a head part thereof (c.f. FIG. 2) to the propellent charge chamber 5, the central bore 7 serving to receive a connecting member for a corresponding ignition charge unit, which is connected to the propellent charge chamber 5 and being sealed from the propellent charge chamber 5 by means of protective foil 55. In the solid part of the metal core 1 surrounding the propellent charge chamber 5, there are two substantially radially directed firing circuit bores 9 in which are located the firing circuit wires 11 of a primer capsule 13 embedded, in the propellent charge 3. The firing circuit wires 11 are sealed off in the firing circuit bores 9 by means of adhesive. Purely in the interests of clarity, the firing circuit bores 9 and the firing circuit wires 11 are shown in a plane which coincides with a threaded hole 21 and a fixing screw 23 and with a perforation 37, but in reality they do not coincide with these latter components.

Also formed in the head part of the metal core 1 is an annular groove 39 into which a corresponding sealing ring can be inserted for further sealing the metal core 1 off from a component mounted thereon, such as a projectile canister, for example.

In the solid part of the metal core 1 surrounding the propellent charge chamber 5, there is also a first set of three bores 17 each formed with an internal shoulder 15, connecting screws 19 for the attachment of a projectile container or canister being provided in said bores 17. The individual bores 17 are arranged equiangularly about the longitudinal axis of the head and are thus spaced at angles of about 120° to one another in the solid part of the metal core 1. Moreover, in the solid part of the metal core 1 surrounding the propellent charge chamber 5, between the bores 17 forming the first set, and in the region of the base part of the metal core 1, there is also a second set of threaded bores 21 in which the threaded shanks of fixing screws 23 for the attachment of a base plate 25 engage. Again, the threaded bores of the second set are arranged at an angle of about 120° to one another in the metal core 1. Thus, the bores 17 and the threaded bores 21 alternate at angles of about 60° to one another in the solid part of the metal core 1.

In the embodiment described, the second set of threaded bores 21 are constructed so as to widen out, substantially from the centre to the head part of the metal core 1, at a stepped portion 35, to form non-threaded perforations 37 which will accommodate the heads of mounting screws by means of which any additional components which may be provided between the contact head 1 and a projectile container connected thereto, such as, for example, a specially constructed chamber for forming a uniform, spherical cloud of smoke, can be screwed to one another and, optionally, to the projectile container as well.

Mounted around the metal core 1 is a protective ring 27, 29, 31 of elastic material, in this case synthetic rubber, which is formed by three individual rings, namely a top ring 27, a middle ring 29 and a bottom ring 31. Contact rings 33 are fitted over the outer casing of the top ring 27 and the outer casing of the bottom ring 31, soldering tabs 43 on the contact rings 33 being located in recesses 41 formed in the top ring 27 and in the bottom ring 31. The soldering tabs 43 are connected to the firing circuit wires 11 located in the firing circuit bores 9. The two contact rings 33 together with their soldering tabs 43 and the firing circuit wires 11 are kept separate and insulated from each other by the middle ring 29.

In the region of the head part of the solid metal core the top ring 27 is constructed to form an annular projecting sealing bead 45. This ensures that the contact head will fit tightly and in sealed manner in a corresponding launcher.

The base part of the metal core 1 is closed by a base plate 25 in which there are a total of six bores 47 of substantially the same size, which coincide with the bores 17 and threaded bores 21 in the metal core 1. The size of the bores 47 is such that the connecting screws 19 located in the bores 17 of the metal core 1 cannot fall out through the base plate 25, and the fixing screws 23 for the base plate 25 can be inserted in the bores 47 in the base plate opposite the threaded holes 21 of the metal core 1. In its central region, opposite the propellent charge chamber 5 of the metal core, the base plate 25 comprises a number of gas outlet ports 49 constructed as breakage points, which are sealed off from the atmosphere by covering foil 51, in this case tin foil sealed with sealing lacquer. A sealing ring 53 ensures a tight seal of the propellent charge chamber 5 between the base part of the metal core 1 and the base plate 25.

FIG. 2 shows in detail the base part of the metal core 1 with the central bore 7 and the annuler groove 39 and a first set of three bores 17 formed in the metal core 1 surrounding the propellent charge chamber, in which bores 17 there are three connecting screws 19, and a second set of three perforations 37 located in the metal core 1 surrounding the propellent charge chamber, the fixing screws 23 being arranged in the threaded bores thereof adjoining the stepped portions 35. The metal core 1 is surrounded by the top ring 27 of the sealing ring, which is constructed to project to form the sealing bead 45. The protective foil 55 can also been seen in the central bore 7.

Figure 3:
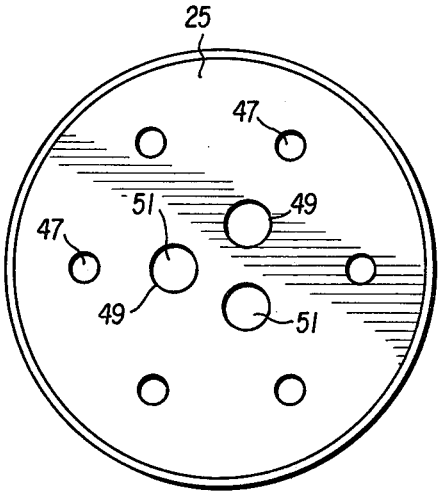
FIG. 3 is a view from below of the base part of the contact head shown in FIG. 1.

FIG. 3 shows in detail the base plate 25 in which there are three bores 47 corresponding to the bores 17 in the metal core 1, and another three bores 47 which correspond to the threaded bores 21 in the metal core and in which there are three fixing screws 23. In the central region of the base plate 25, there are four gas outlet ports 49 which are sealed off by the covering foil 51.

We claim:

1. A contact head for a projectile which is capable of being fired from an electrically actuable launcher, said head comprising a solid metal core formed on one side with a recess constituting a propellent charge chamber, formed with a central bore leading to said recess for reception of an ignition charge unit, formed with substantially radially extending bores leading into said recess for the reception of firing circuit wires, formed in the part surrounding said recess with a first set of bores having an internal shoulder substantially in the centre of the thickness of said part for receiving connecting screws for attaching the contact head to a container of said projectile, and formed also in the part surrounding said recess with a second set of threaded bores for receiving the threaded shanks of fixing screws, said bores of said first and second sets alternating at substantially equal angles about the longitudinal axis of said core; a propellent charge located in said propellent charge chamber; a primer capsule disposed in said propellent charge; an elastic protective ring member coaxially surrounding said core; first and second contact rings carried by said protective ring member; fixing circuit wires connecting said first and second contact rings and said primer capsule; a base plate secured to said one side of the core so as tightly to seal off at least said propellent charge chamber, the base plate being formed with bores corresponding with and adapted to register with the bores of the first and second sets formed in the part of the core surrounding said recess, and having breakage points for the egress of gases upon ignition of said propellent charge; connecting screws received in said bores of said first set of bores; and fixing screws fixing said base plate to the core and threadedly engaging in the bores of the second set of bores.

2. The contact head of claim 1, wherein there are two to four bores in said first set of bores.

3. The contact head of claim 1, wherein there are two to four bores in said second set of bores.

4. The contact head of claim 1, wherein there are three bores in each set of bores.

5. The contact head of claim 1, wherein the elastic protective ring member is in three parts comprising a top ring, a middle ring and a base ring lying adjacent said base plate, and wherein the first contact ring is carried by said top ring and the second contact ring is carried by said base ring, each contact ring having a soldering tab for a firing circuit wire disposed in an appropriate recess between two adjacent protective rings.

6. The contact head of claim 5, wherein the top ring of the elastic protective ring member is constructed to form an annular sealing bead.

7. The contact head of claim 1, wherein each bore of the second set of threaded bores is constructed to widen out substantially from the centre of the thickness of said part of the core surrounding the chamber towards the other side of the core at a stepped portion to form a non-threaded perforation for receiving the head of a mounting screw, by means of which mounting screws any additional components provided between the contact head and a projectile container connected thereto can be screwed to one another and optionally also to the projectile container.

8. The contact head of claim 1, wherein an annular groove for receiving a ring seal is formed on the other side of the metal core between the central bore and the locations for the axes of the first and second sets of bores.

9. The contact head of claim 1, wherein the bores in said base plate coinciding with the first set of bores in said core part are smaller than the diameter of the heads of the connecting screws located therein and are large enough to allow the insertion of a socket head spanner for actuating these connecting screws.

* * * * *

UNITED STATES PATENT AND TRADEMARK OFFICE

CERTIFICATE OF CORRECTION

PATENT NO. : 4,370,929

DATED : February 1, 1983

INVENTOR(S) : Wolfgang Seinicke et al

It is certified that error appears in the above-identified patent and that said Letters Patent is hereby corrected as shown below:

On the title page Insert

--(73) Assignee: Buck Chemische Technische Werke GmbH & Co., Federal Republic of Germany --.

Signed and Sealed this

*Seventh* Day of *June 1983*

[SEAL]

*Attest:*

DONALD J. QUIGG

*Attesting Officer*

*Acting Commissioner of Patents and Trademarks*